US006719230B2

(12) United States Patent
Baranov et al.

(10) Patent No.: US 6,719,230 B2
(45) Date of Patent: Apr. 13, 2004

(54) COLLAPSIBLE YARN CARRIER TUBE

(75) Inventors: Fedar Baranov, Inman, SC (US); Brian P. Couchey, Inman, SC (US); Victor J. DesRosiers, Kinderhook, NY (US); William E. Leidel, Greer, SC (US); James P. Stevens, Castleton, NY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/060,522

(22) Filed: Jan. 29, 2002

(65) Prior Publication Data

US 2003/0141397 A1 Jul. 31, 2003

(51) Int. Cl.[7] ..... B65H 75/20
(52) U.S. Cl. ..... 242/118.11; 242/604; 242/605
(58) Field of Search ..... 242/118.11, 118.1, 242/118.2, 605, 604; 68/198

(56) References Cited

U.S. PATENT DOCUMENTS

| | | | | |
|---|---|---|---|---|
| 397,539 | A | 2/1889 | Dahlgren | |
| 1,495,302 | A | 5/1924 | Hartshorne | |
| 2,138,383 | A | 11/1938 | Little et al. | 93/1 |
| 2,162,841 | A | 6/1939 | Dunlap | 242/119 |
| 2,217,459 | A | 10/1940 | Slaughter | 68/198 |
| 2,338,513 | A | 1/1944 | Helm | 242/118 |
| 2,413,091 | A | 12/1946 | Wolfenden | 242/118 |
| 2,633,729 | A | 4/1953 | Slaughter | 68/198 |
| 3,465,984 | A | 9/1969 | Tigges et al. | 242/118.11 |
| 3,561,697 | A | 2/1971 | Egyptien | 242/118.11 |
| 3,563,491 | A | 2/1971 | Hahm et al. | 242/118.11 |
| 3,647,156 | A | 3/1972 | Henning | 242/118.11 |
| 3,718,287 | A | 2/1973 | Sottosanti | 242/118.11 |
| 3,756,532 | A | 9/1973 | Draper | 242/118.11 |
| 3,759,461 | A | 9/1973 | Draper | 242/118.11 |

(List continued on next page.)

FOREIGN PATENT DOCUMENTS

| | | |
|---|---|---|
| DE | 2408949 | 9/1975 |
| EP | 471353 A1 | 2/1992 |
| FR | 610248 | 9/1926 |
| JP | 447739 | 4/1969 |
| NL | 87276 | 1/1958 |
| SE | 61574 | 9/1926 |

OTHER PUBLICATIONS

Photograph of dye tube by Sonoco Crellin, Inc. of Greenville, South Carolina, known prior to the filing date for this application. These photographs are of tubes known, dates of at least before or on Jan. 28, 2002.

Photograph of dye tube by Technimark, Inc. of Asheboro, North Carolina, known prior to the filing date for this application. These photographs are of tubes known, dates of at least before or on Jan. 28, 2002.

*Primary Examiner*—John M. Jillions
(74) *Attorney, Agent, or Firm*—Drinker Biddle & Reath LLP

(57) ABSTRACT

A carrier tube is provided for retaining yarn packages during a dyeing operation, the tube including axially aligned rings spaced from one another along at least a portion thereof. Longitudinally extending columns or ribs intersect each of the rings to form a lattice structure over at least a portion of the surface of the tube body in which apertures are defined by the rings and ribs. Each of the ribs includes interspersed reduced load carrying sections that deflect compressively in response to axial load applied to the tube. The deflections of the reduced load carrying sections accumulating over the length of the ribs to permit axial acceptance of the load. The carrier tube also having radial reduction sections connected to the rings to accept a radial reduction of the tube in response to compressive load created by the yarn during the dyeing operation.

28 Claims, 5 Drawing Sheets

U.S. PATENT DOCUMENTS

| | | | | | |
|---|---|---|---|---|---|
| 3,929,301 | A | | 12/1975 | Frank et al. | 242/118.11 |
| 4,136,842 | A | | 1/1979 | Livingstone et al. | 242/118.11 |
| 4,181,274 | A | | 1/1980 | Burchette, Jr. | 242/118.11 |
| 4,270,710 | A | | 6/1981 | Ono | 242/118.11 |
| 4,349,165 | A | | 9/1982 | Henning et al. | 242/118.11 |
| 4,402,474 | A | | 9/1983 | Henning | 242/118.1 |
| 4,441,665 | A | | 4/1984 | Hahm | 242/129 |
| 4,454,734 | A | | 6/1984 | Marquis et al. | 68/198 |
| 4,621,508 | A | * | 11/1986 | Baxley et al. | 242/118.11 X |
| 4,720,057 | A | | 1/1988 | Ono et al. | 242/118.11 |
| 4,823,565 | A | | 4/1989 | Hahm | 68/198 |
| 4,941,621 | A | | 7/1990 | Pasini | 242/118.1 |
| 4,946,114 | A | | 8/1990 | Becker et al. | 242/118.1 |
| 4,962,650 | A | | 10/1990 | Hahm | 68/198 |
| 4,986,488 | A | | 1/1991 | Windhosel et al. | 242/118.1 |
| 5,094,404 | A | | 3/1992 | DesRosiers et al. | 242/118.11 |
| 5,152,475 | A | | 10/1992 | Pasini | 242/118.1 |
| 5,178,342 | A | | 1/1993 | Romagnoli | 242/118.1 |
| 5,411,217 | A | | 5/1995 | Ono | 242/118.11 |
| 5,427,322 | A | | 6/1995 | DesRosiers | 242/118.11 |
| 5,435,497 | A | | 7/1995 | Romagnoli | 242/118.11 |
| 5,445,335 | A | | 8/1995 | Hallman et al. | 242/118.1 |
| 5,501,406 | A | | 3/1996 | Henning | 242/118.11 |
| 5,577,677 | A | * | 11/1996 | Frings et al. | 242/118.11 |
| 5,584,439 | A | | 12/1996 | Romagnoli | 242/118.11 |
| 5,632,451 | A | | 5/1997 | Pasini | 242/118.11 |
| 5,820,049 | A | | 10/1998 | Atkinson | 242/118.1 |
| 6,032,890 | A | | 3/2000 | DesRosiers | 242/125.1 |
| 6,367,724 | B1 | * | 4/2002 | Atkinson et al. | 242/118.11 |

* cited by examiner

COLLAPSIBLE YARN CARRIER TUBE

FIELD OF THE INVENTION

The present invention relates to a carrier tube for package dyeing of textile products such as yarn and the like and, more particularly, to a collapsible carrier tube.

BACKGROUND OF THE INVENTION

In the textile industry, carrier tubes are utilized to support yarn during a dyeing process. The yarn is wound onto a carrier tube at high speeds to form a substantially cylindrical package of yarn on the tube. The yarn-supporting tubes are then supported on the spindle of a dye kettle for application of a dye medium. The tubes are commonly formed with mating ends to facilitate nested stacking of multiple yarn packages on one spindle. A dye medium is introduced into the dye kettle via the spindle for radial passage of the dye through the carrier tube and the supported yarn package. The carrier tubes are perforated to provide the necessary passageway for the dye from the spindle to the yarn. Known carrier tubes include tubes having intersecting elements which form a lattice type structure to provide the necessary perforations.

The prior art includes tubes made from metals such as stainless steel. However, metal tubes require thorough cleaning before reuse to prevent a previously applied dye medium from contaminating a dye medium subsequently applied. Known carrier tubes also include tubes made from plastic. Material and manufacturing cost efficiencies relating to molding of plastics facilitate the mass production of tubes for generally disposable use thereby eliminating the need to clean the tubes for re-use.

The perforations in the tube providing for passage of the dye medium should not excessively reduce the structural integrity of the tube. The perforated carrier tube must possess sufficient strength to carry loading applied to the tube. For example, the tubes typically incur an axial load after mounting on a spindle to seal the ends of the tube and to ensure that the dye medium will pass radially through the yarn rather than out of the ends of the tube.

Another factor to be considered is the thermal expansion of the tube and spindle. The dye medium used in the dyeing process is typically heated to a temperature that is slightly lower than the melting temperature of the plastic. This temperature results in a substantial softening of the plastic, making deformation under load relatively easy. Also, since the plastic material of the tube expands at a greater rate than the metal of the spindle, an additional axial load is created on the tube during the dyeing process. Considering this load and the relative softness of the plastic at the elevated temperatures, structural integrity of the tube may become compromised (at least to the extent of creating problems during unwinding of the dyed yarn).

Prior art tubes have incorporated flexible, or collapsible, structures to provide for axial compression in response to compressive loading such as that induced by restrained thermal expansion. Examples of axially compressible carrier tubes are shown in U.S. Pat. Nos. 4,986,488 to Windhosel et al. and 4,946,114 to Becker et al. In Windhosel, ring sections of a central portion of the tube are interconnected by webs. Each of the interconnecting webs is twice bent at right angles to provide flexibility in the axial direction. The webs function in the nature of springs rather than load bearing ribs of a lattice structure. In a similar fashion, Becker discloses ring sections interconnected by spacing members. Each of the spacing members throughout the tube is bowed to provide for compression of the spacing members in response to compressive axial load.

The heat of the dye medium tends to shrink the yarn within the yarn package. The winding of the yarn on the tube creates a radially inward load around the circumference of the tube. To prevent damage to the yarn in response to compressive loads induced by the shrinkage of the yarn against the tube, on which the yarn is wound, prior art tubes have incorporated flexible, or collapsible, structures providing for radial collapse.

Examples of radially compressible tubes are shown in U.S. Pat. No. 5,632,451 to Pasini and European Publication 0471353A of Zimmermann. Pasini discloses alternating transversely deformable longitudinal members and rigid longitudinal members. Stiffening tacks connect the alternating longitudinal members. Application of compressive hoop load to the tube, from shrinking yarn for example, causes deformation of the transversely deformable members and radial collapse of the tube as the rigid members adjacent the deformable members are directed towards one another. In Zimmermann, a lattice structure includes ring sections that do not intersect with each of the longitudinal members and are instead secured to some of the members by bowed elements. The bowed elements permit flexibility and radial compression of the carrier tube under compressive hoop loading.

A potential problem associated with known carrier tubes that provide for collapse of the tube, especially in the axial direction, is pinching of the yarn between collapsing portions of the carrier tube. The potential for pinching is greater where the collapsibility of the tube is concentrated such that a large percentage of the overall collapse of the tube occurs at each location of collapsible structure.

SUMMARY OF THE INVENTION

It is an object of the present invention to provide a collapsible carrier tube for supporting a wound package of yarn in a dyeing process in which predefined collapsible portions are interspersed within the structure to permit the tube to maintain its structural integrity in response to yarn reactions to the dyeing process.

According to one embodiment of the present invention, there is provided a carrier tube for dyeing yarn packages. The carrier tube comprises a series of axially spaced rings and a series of columns or ribs extending longitudinally along the tube. The ribs and rings define the wall of the tube and form a lattice structure to support yarn wound thereon and having openings therein to permit the dye to be introduced from inside the tube to the yarn wound on the exterior of the tube. Each of the ribs includes at least one reduced load carrying section, which is capable of compressing in response to an axial loading of the tube during the yarn dying process. In a preferred structure, multiple reduced load carrying sections may be interspersed on each of the ribs within the lattice structure.

According to another embodiment of the present invention, the lattice structure of the tube includes at least one reduced load carrying members within each of the rings such that application of a hoop load results in compressive deflection of the reduced load carrying members. In a preferred structure, multiple reduced load carrying members may be interspersed along the length of each of the ribs within the lattice structure.

It should be understood that the reduced load carrying sections on the rings and the reduced load carrying members on the ribs may be combined within the overall lattice structure. The number and form of the reduced load carrying sections and members may be varied as desired, depending on the operating conditions, materials, yarn, temperatures and other factors involved.

BRIEF DESCRIPTION OF THE DRAWINGS

For the purpose of illustrating the invention, there is shown in the drawings a form that is presently preferred; it being understood, however, that this invention is not limited to the precise arrangements and structures shown.

DETAILED DESCRIPTION OF THE DRAWINGS

Figure 1:
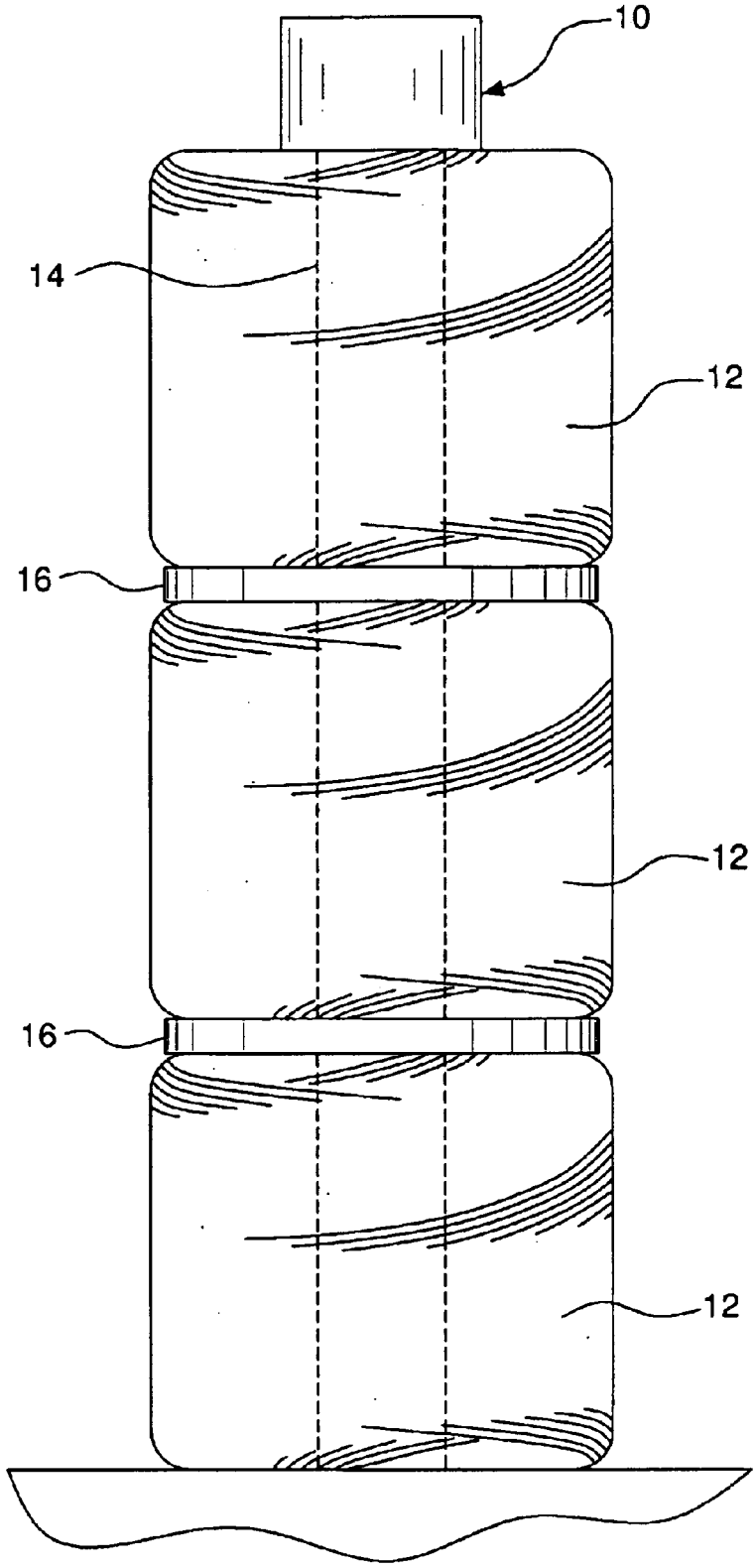
FIG. 1 is an elevational view of packages of wound yarn received on stacked carrier tubes according to the present invention.

Referring to the drawings where like numerals refer to like elements, there is shown in FIG. 1 an assembly 10 of yarn packages 12. The yarn packages 12 may be supported on the spindle 14 of a dye kettle for dyeing by a dye medium. The packages 12 are separated from one another by spacers 16. In the manner well known in the art, each of the yarn packages is formed by winding of the yarn onto a tubular carrier not seen in FIG. 1. Each of the tubular carriers having a yarn package wound thereon is received onto the spindle in a stack of carriers such as the assembly 10 shown in FIG. 1.

Figure 2:
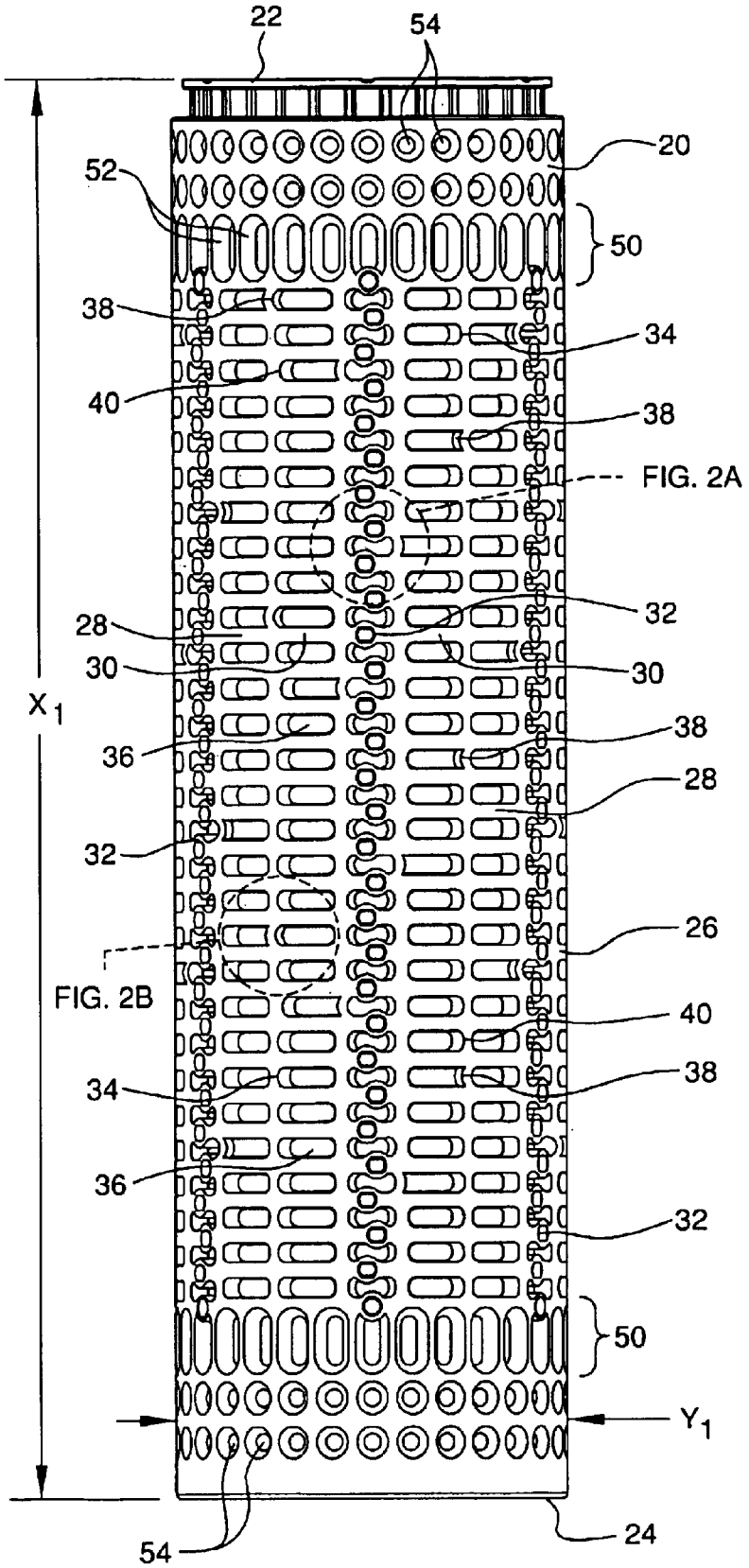
FIG. 2 is an elevational view of a collapsible carrier tube according to the present invention.

Referring to FIG. 2, there is shown a yarn carrier 20 according to the present invention. The yarn carrier 20 is tubular structure having an inner diameter sized for slidable receipt on the spindle within a dye kettle, such as the spindle 14 shown (in phantom) in FIG. 1. Each of the yarn carriers 20 includes a male fitting 22 formed as part of a first end ring positioned at one end of the yarn carrier tube. A second or female nesting fitting 24 is formed as part of a second end ring at the opposite end of the tube. The male fitting 22 has an outside diameter sized for receipt within the female fitting 24 when two tubes are stacked or otherwise positioned end-to-end forming the assembly 10 of yarn packages shown in FIG. 1. The form of the male and female fittings may vary as desired. The structural and operational parameters for this nested fitting will be understood by those of skill in the art.

The tubular carrier 20 includes a central body portion 26 for supporting a wound yarn package such as package 12 of FIG. 1. The body portion 26 is porous to provide the necessary passageway for the dye from the spindle of a dye kettle to the supported yarn package. The body portion 26 includes a plurality of intermediate rings 28 that are axially aligned with one another and equidistantly spaced along the length of the body of the tube. Each of the rings includes a series of elongated ring sections 30 extending circumferentially about the body portion 26. Each of the rings 28 also includes hoop or radial reduction sections 32 linking two adjacent ring sections 30. Each of the radial reduction sections is capable of accepting a radially compressive load on the tube.

The body portion 26 further includes columns or ribs 34 each extending longitudinally along the length of the body portion 26 and intersecting each of the rings 28 to form a lattice structure. Each of the ribs 34 supports the carrier tube under axial load. The ribs and rings define perforations 36 that provide for passage of a dye medium through the carrier tube. The intersections of the ribs and rings result in a highly stable structure capable of maintaining structural integrity of the tube under loading imposed during the winding, unwinding and dyeing processes.

Figure 2A:
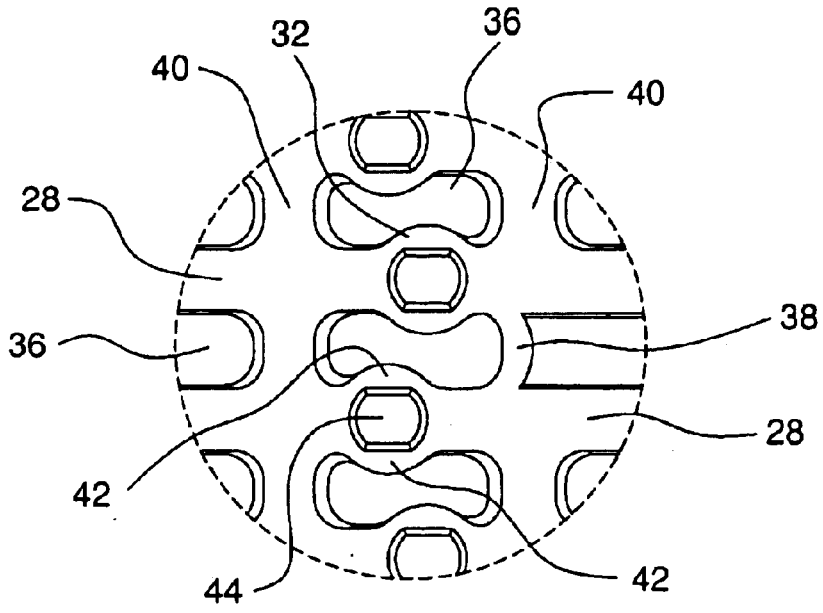
FIGS. 2A and 2B are detail views of the carrier tube of FIG. 2 schematically illustrating portions of the carrier tube in a planar configuration.
Figure 2B:
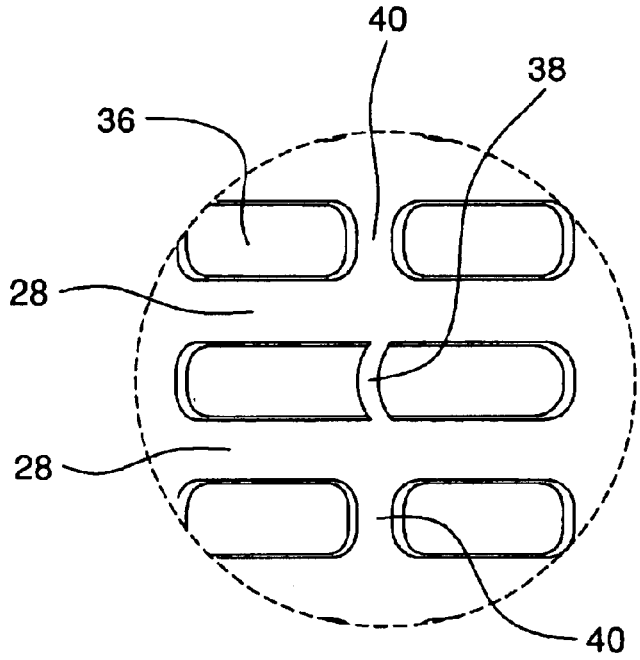

Referring to FIG. 2B, each of the ribs has sections that extend between adjacent rings 28 within the lattice structure. Each of the ribs includes reduced load carrying, or axial deflection, sections 38 and primary load carrying sections 40. The reduced load carrying sections 38 are interspersed among the primary load carrying sections 40 along the length of the central body 26.

The side surfaces of each of each of primary sections 40 taper radially such that the primary sections are thickest along the inner surface of the body portion 26. Each of the reduced load carrying sections 38 has non-tapering sides such that the section has a constant thickness. As illustrated, the load carrying sections 38 are sized such that the thickness is relatively less than the thickness of the primary sections 40. As a result, the cross sectional area of the reduced load carrying sections 38 is less than that of the primary sections 40. The reduced cross sectional area results in an increase in flexibility and a reduction in the load carrying capability of sections 38 as compared to primary sections 40. The reduced load carrying sections 38 as illustrated are formed with a curved profile in the axial direction of the tube. The curved profile increases the likelihood that sections 38 will deflect under load as opposed to the primary sections 40.

Although illustrated as being curved, the reduced load carrying sections 38 could have straight sidewalls, form a chevron shape, form an "S" shaped or other wise be formed to encourage deflection upon a compression force being applied to the tube. In addition, the sections are shown as having a relatively smaller cross section, as compared to the primary sections 40 of the ribs 34. It is contemplated that the shape of the reduced load sections 38 alone may create the desired compression of the tube in response to an axial load. It is preferred, however, that the sections be positioned along the axial line of the ribs, even considering the curved or other deflection that will promote compression.

Figure 3:
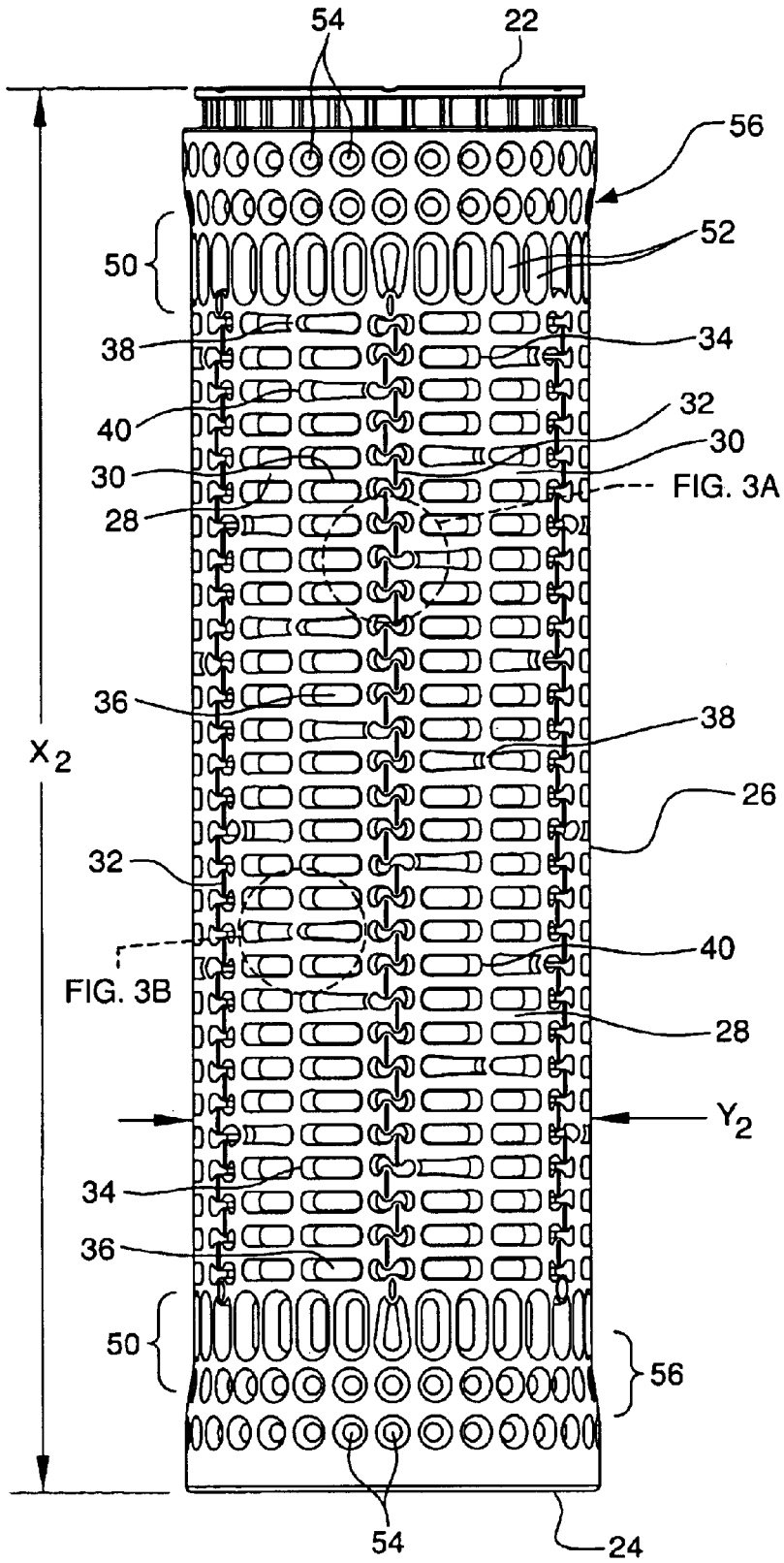
FIG. 3 is an elevational view of the carrier tube of FIG. 2 in which the carrier tube has been partially axially and radially collapsed.

The carrier tube 20 is illustrated in FIGS. 2 and 2A in an initial condition in which the tube has not been collapsed in either of the axial or radial directions. The initial length of the tube prior to axial collapse is shown as $X_1$. The initial diameter of the tube prior to radial collapse is shown as $Y_1$. Upon the application of a sufficient axial load to the carrier tube, the reduced load carrying sections 38 of ribs 34 will deflect such that opposite ends of the sections 38 and the adjacent rings that are separated by the reduced load carrying sections will approach one another. The deflected condition of the reduced load carrying sections 38 is seen in FIGS. 3 and 3B. As shown, the reduced load carrying sections 38 for each rib 34 are dispersed along the length of the rib. Each of the reduced load carrying sections 38 for a given rib 34 is located between an adjacent pair of rings 28 axially adjacent to non-deflecting primary sections 40 located between adjoining pairs of rings 28. For each of the ribs 34, therefore, the compressive deflections of the separate sections 38 will accumulate over the length of the ribs 34 to form an overall shortening of the ribs and a reduction in the diameter of the tube.

Figure 3A:
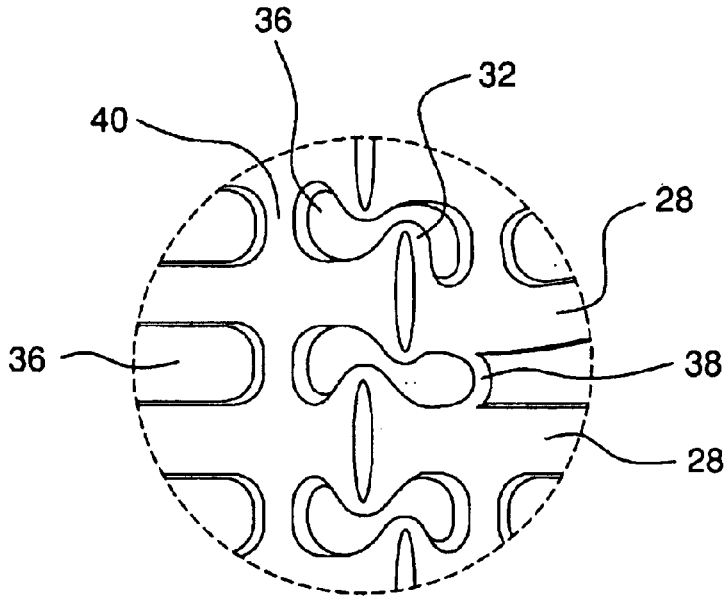
FIGS. 3A and 3B are detail views of the collapsed carrier tube of FIG. 3 schematically illustrating portions of the carrier tube in a planar configuration.
Figure 3B:
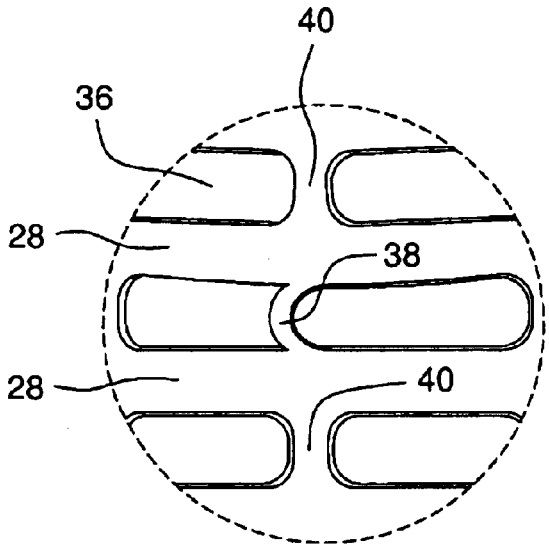

Referring to FIGS. 2A and 3A, the interspersed reduced load carrying sections 38 are also staggered circumferentially about the body portion 26 such that the reduced sections 38 of each of the ribs is axially offset with respect to the reduced sections of adjacent ribs. In other words, each adjacent pair of rings 28 is connected to at least one rib 34 having a non-deflecting primary section 40 located between the adjacent rings 28. As a result, there are no adjacent pair of rings that are interconnected solely by reduced load carrying sections. This construction serves to further spread the axial collapse of the lattice structure about the body portion 26. As a result, the axial collapse at each location of collapse is minimized both in terms of the circumferential extent of the collapse as well as the axial magnitude of the collapse. The spreading of the collapse in this manner serves to limit the potential for pinching of a yarn package previously wound on the body portion 26 of the carrier tube 20 prior to the axial collapse. The resulting shortened length of the tube is shown in FIG. 3 as $X_2$. It is preferable that all of the ribs have the same number of reduced load carrying sections. This facilitates uniformity in the collapse of the structure under sufficient axial load.

Referring to FIGS. 2 and 2A, each of the radial reduction sections 32 is connected the ring 28 intermediately between a pair of adjacent rib sections 40. The reduction sections 32 are capable of carrying load to provide for hoop continuity of the rings 28. As best seen in FIG. 2A, each of the radial reduction sections 32 includes a pair of opposing arms 42 that define an opening 44 therebetween. Each of the arms 42 is formed to have a bowed profile along its length. The bowing of the arms is axially out of the plane of the rings 28 such that the load carrying capability of the radial reduction sections 32 is reduced with respect to the adjacent elongated ring sections 30 of rings 28. As a result, the application of a sufficient compressive hoop load to the rings will result in collapse of the radial reduction sections 32 and radial compression of the rings. The collapsed condition of radial reduction sections 32 is seen in FIGS. 3 and 3A. The radially compressed condition of the body portion of the carrier tube 20 is seen in FIG. 3 in which the diameter of the body portion 26 after compression is shown as $Y_2$.

Between the nesting sections 22, 24 at opposite ends of the tube 20 and the central lattice structure of the ribs 40 and rings 28, there is provided a transition zone, which is generally designated by the numeral 50 in FIGS. 2 and 3. The two transition zones 50 include axially aligned elongated oval openings 52 within the sidewall of the tube. Outwardly of the transition zones 50, the nesting areas 22, 24 preferably include solid walls with no openings. A series of dimples 54 are provided on the outer surface of the nesting areas 22, 24. It is contemplated that the yarn will be wound onto the tube 20 past the both the upper and lower transition zones 50 and will at least partially cover the dimpled surface of the nesting areas 22, 24. Dye being forced through the lattice of the tube will flow through the openings 52 and into the wrapped yarn (not shown). The solid wall of the nesting areas, in effect, forms a seal with respect to the flow of dye.

As shown in FIG. 3, the shrinkage of the yarn during the dying process causes a radial reduction in the tube, which is softened by the heat of the dye. For the most part the radial reduction sections 32 absorb the forces created by the shrinking yarn on the softened tube so as to provide for a stable support of the yarn. It has also been found that the diameter of the transition zones also experiences a net reduction as a result of the dying operation. As illustrated in FIG. 3, the portion of the nesting areas 22, 24 which are directly adjacent the transition zones 50 also tapers 56 as a result of the forces applied by the shrinking yarn.

The lattice structure of the yarn carrier 20 thus provides for collapsibility of the yarn carrier both axially and radially. Although the carrier tube 20 is shown in FIGS. 3 and 3A collapsed axially and radially, it should be understood by those skilled in the art that the axial and radial collapse mechanisms are capable of operating independently from one another. Therefore, the application of sufficient axial load to deflect the reduced load carrying sections 38 of the ribs 34 will not result in deflection of the radial reduction sections 32 of the rings 28 in the absence of sufficient compressive hoop load, and vice versa. The provision of ribs 34 that are load bearing throughout the entire length of the ribs and that intersect each of the rings 28 results in a robust lattice structure. The lattice structure provides for substantially rigid support of load both axially and radially in the absence of loading sufficient to collapse the reduced load carrying sections 38 or the radial reduction sections 32.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather should be construed in breadth and scope in accordance with the recitation of the appended claims.

What is claimed is:

1. A carrier tube for dyeing yarn packages, the carrier tube comprising:

a longitudinally extending, hollow, tubular body including a lattice portion having a length and a circumference, the lattice portion including a plurality of rings, the rings axially aligned and spaced along the length of the lattice portion, the lattice portion further including a plurality of ribs, the ribs extending along a longitudinal line and radially spaced about the circumference of the lattice portion, each rib extending continuously along the length of the lattice portion of the tubular body and intersecting each of the rings to define apertures therebetween, each of the ribs comprising at least one axial compression section substantially aligned with the longitudinal line of the rib and located between a pair of adjacent rings, the axial compression section having a reduced load carrying capability with respect to axially adjacent portions of the same rib located between adjoining pairs of rings, the axial compression section adapted to deflect compressively in response to axial load on the tube.

2. The carrier tube according to claim 1 wherein each of the ribs comprises multiple axial compression sections and wherein the axial compression sections are interspersed along the length of the rib, the axial compression sections of the ribs arranged such that deflection of the axial compression sections accumulates equally about the tube.

3. The carrier tube according to claim 1 wherein each of the axial compression sections has a curved profile along at least a portion of the section.

4. The carrier tube according to claim 1 wherein the axial compression section of each rib has a cross sectional area that is reduced with respect to the adjacent portions of the same rib.

5. The carrier tube according to claim 1 wherein each of the ribs has an equal number of axial compression sections.

6. The carrier tube according to claim 1, wherein each pair of adjacent rings that is connected to a rib adapted to deflect between the adjacent rings is also connected to at least one rib that is adapted to be substantially non-deflecting between the adjacent rings.

7. The carrier tube according to claim 6, wherein each rib that is adapted to deflect between the pair of adjacent rings is located circumferentially between two ribs each adapted to be substantially non-deflecting between the adjacent rings.

8. A carrier tube for dyeing yarn packages, the carrier tube comprising:

a longitudinally extending, hollow, tubular body including a lattice portion having a length and a circumference, the lattice portion including a plurality of rings, the rings axially aligned and spaced along the length of the lattice portion, the lattice portion further including a plurality of ribs, the ribs extending along a longitudinal line and radially spaced about the circumference of the lattice portion, each rib extending continuously along the length of the lattice portion of the tubular body and intersecting each of the rings to define apertures therebetween, each of the ribs comprising at least one axial compression section substantially aligned with the longitudinal line of the rib and having a reduced load carrying capability with respect to adjacently located portions of the same rib to deflect compressively in response to axial load on the tube, each of the rings comprising at least one radial reduction section, each radial reduction section capable of compressive deflection upon application of a radial inward load around the circumference of the tube.

9. The carrier tube according to claim 8 Wherein each radial reduction section is at least partially defined by a portion which is axially out of the plane of the rings.

10. The carrier tube according to claim 8 Wherein each radial reduction section comprises a reduced cross sectional area relative to the remainder of the rings.

11. The carrier tube according to claim 8 wherein the radial reduction sections for each of the rings are offset circumferentially with respect to the radial reduction sections of a directly adjacent ring.

12. A cylindrical, hollow tube for supporting a wound package of yarn during a dyeing operation, the tube including an apertured portion having a length and a circumference, the apertured portion of the tube comprising:

a plurality of rings axially spaced from one another along the length of the apertured portion of the tube; and a plurality of ribs, the ribs extending longitudinally and equidistantly spaced from one another around the circumference of the apertured portion of the tube, each of the ribs extending continuously along the length of the apertured portion and intersecting each of the rings to define openings therebetween, each of the ribs extending along a longitudinal line and including at least one axial deflection section in substantial alignment with the longitudinal line of the rib and located between a pair of adjacent rings, each axial deflection section having a reduced transverse cross section as compared to axially adjacent portions of the same rib located between adjoining pairs of rings, the deflection section adapted to collapse axially in response to axially compressive load on the tube.

13. The tube according to claim 12 wherein each of the axial deflection sections of the ribs has a bend that is at least partially offset from the longitudinal line of the associated rib.

14. The tube according to claim 13 wherein the bend of the axial deflection sections has a curved profile.

15. The tube according to claim 12 wherein each rib has an equal number of axial deflection sections.

16. A cylindrical, hollow tube for supporting a wound package of yarn during a dyeing operation, the tube including an apertured portion having a length and a circumference, the apertured portion of the tube comprising:

a plurality of rings axially spaced from one another along the length of the apertured portion of the tube; and a plurality of ribs, the ribs extending longitudinally and equidistantly spaced from one another around the circumference of the apertured portion of the tube, each of the ribs extending continuously along the length of the apertured portion and intersecting each of the rings to define openings therebetween, each of the ribs extending along a longitudinal line and including at least one axial deflection section in substantial alignment with the longitudinal line of the rib, each axial deflection section having a reduced transverse cross section as compared to adjacent portions of the same rib to collapse axially in response to axially compressive load on the tube, at least one radial reduction section within each of multiple rings of the plurality of rings, each radial reduction section being deflectable to reduce the overall circumference of the associated ring and a corresponding reduction in its diameter during application of compressive hoop load.

17. A dye tube in the form of an open-ended cylinder having an inner surface and an outer surface, the dye tube comprising:

a first end ring and an opposite second end ring, each end ring formed to permit a first tube to mate with and be stacked on top of another similarly formed tube;

a plurality of intermediate rings disposed between the first end ring and the second end ring, the intermediate rings centered on and sharing a common axis with the end rings, each intermediate ring having at least one radial reduction section, each radial reduction section being deflectable so as to reduce the overall circumference of the associated intermediate ring and a corresponding reduction in the diameter of the tube in the area of the ring during application of compressive hoop load; and a plurality of ribs extending continuously along a longitudinal line between the end rings and integrally connected therewith, each of the ribs intersecting each of the intermediate rings to form a lattice structure defining apertures, each rib including at least one axial deflection section extending in substantial alignment with the longitudinal line of the rib between two adjacent intermediate rings, the axial deflection section being at least partially collapsible in response to an axially compressive load on the tube.

18. The tube according to claim 17 wherein each of the axial deflection sections of the ribs is offset axially along the tube from the axial deflection sections of adjacent ribs.

19. The tube according to claim 17 wherein each axial deflection section has a curved profile.

20. The tube according to claim 17 wherein each rib has an equal number of axial deflection sections along its length.

21. The tube according to claim 18 wherein each rib comprises a plurality of axial deflection sections.

22. The tube according to claim 17 wherein the radial reduction sections form a circular profile and have an opening within the center of the sections, intermediate of the rings.

23. A dye tube in the form of an open-ended cylinder having a lattice portion, the lattice portion having an inner surface and an outer surface, the dye tube comprising:

a first end ring and a second end ring, each end ring having edges formed thereon to permit the tube to mate with and be stacked on top of another similarly formed tube;

a plurality of intermediate rings disposed between the first end ring and the second end ring, the intermediate rings centered on and sharing a common axis with the rings, each intermediate ring having at least one radial reduction section, the radial reduction section being deflectable so as to reduce the overall circumference of the ring and a corresponding reduction in the diameter of the tube in the area of the ring during application of compressive hoop load, each of the radial reduction sections substantially circular in shape and having an opening within the center of the section, the radial reduction sections on adjacent intermediate rings being radially offset from one another; and a plurality of continuous, longitudinal, ribs extending substantially from the first end ring to the second end ring and integrally connected therewith, the ribs intersecting each of the intermediate rings to form the lattice structure with apertures therebetween, each rib including at least one axial deflection section extending between two adjacent intermediate rings, the axial deflection section being at least partially collapsible in response to an axially compressive load on the tube.

24. The tube according to claim 23 wherein the radial offset of the adjacent radial reduction sections is retained within the distance between adjacent ribs.

25. The tube according to claim 24 wherein each intermediate ring includes a plurality of radial reduction sections.

26. A yarn carrier tube comprising:

a tubular body including a plurality of rings, the rings axially aligned and spaced longitudinally, the tubular body further including a plurality of ribs, the ribs extending along a longitudinal line and spaced circumferentially, each rib extending continuously to intersect each of the rings to define apertures therebetween, each of the ribs adapted to deflect compressively between at least one pair of adjacent rings in response to axial loading on the tube, each pair of adjacent rings that is connected to a rib adapted to deflect compressively between the adjacent rings is also connected to at least one other rib that is adapted to be substantially non-deflecting between the adjacent rings.

27. The yarn carrier tube according to claim 26, wherein each of the ribs is adapted to be substantially non-deflecting between at least one pair of adjacent rings.

28. The yarn carrier tube according to claim 27, wherein each of the ribs is adapted to be substantially non-deflecting between at least one pair of rings adjoining each pair of rings where the rib is adapted to deflect compressively.

* * * * *